US011781553B2

(12) United States Patent
Terminio et al.

(10) Patent No.: US 11,781,553 B2
(45) Date of Patent: Oct. 10, 2023

(54) VACUUM PUMP WITH ELASTIC SPACER

(71) Applicant: Agilent Technologies, Inc., Santa Clara, CA (US)

(72) Inventors: Federico Terminio, Turin (IT); Simone Cau, Settimo Torinese (IT)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 17/540,199

(22) Filed: Dec. 1, 2021

(65) Prior Publication Data

US 2022/0170471 A1 Jun. 2, 2022

(30) Foreign Application Priority Data

Dec. 2, 2020 (GB) ..... 2019017

(51) Int. Cl.
*F04D 19/04* (2006.01)

(52) U.S. Cl.
CPC ..... *F04D 19/046* (2013.01)

(58) Field of Classification Search
CPC ..... F04D 19/04; F04D 19/042; F04D 19/044; F04D 19/046
See application file for complete search history.

(56) References Cited

U.S. PATENT DOCUMENTS

| | | | | |
|---|---|---|---|---|
| 5,466,119 | A | 11/1995 | Boivin et al. | |
| 6,030,189 | A | 2/2000 | Bohm et al. | |
| 6,106,223 | A | 8/2000 | Leyshon | |
| 6,435,811 | B1 * | 8/2002 | Beyer | F04D 17/168 415/199.5 |
| 7,811,065 | B2 * | 10/2010 | Stuart | F04D 29/601 417/423.4 |
| 7,993,113 | B2 | 8/2011 | Namiki et al. | |
| 8,221,052 | B2 | 7/2012 | Tsutsui | |
| 2010/0260594 | A1 | 10/2010 | Englaender | |
| 2014/0205432 | A1 * | 7/2014 | Emelli | F04D 19/046 415/65 |

FOREIGN PATENT DOCUMENTS

| | | | |
|---|---|---|---|
| EP | 1249613 | A1 | 10/2002 |
| EP | 919726 | B1 | 2/2004 |
| EP | 2757266 | A1 | 7/2014 |
| GB | 2360066 | A | 9/2001 |
| JP | 60162097 | A | 8/1985 |
| JP | 5664253 | B2 | 12/2014 |
| WO | WO-2021085444 | A1 * | 5/2021 |
| WO | WO-2021090738 | A1 * | 5/2021 |

OTHER PUBLICATIONS

UK Search Report dated Apr. 30, 2021 for application GB2019017.9; 4 pages.

* cited by examiner

*Primary Examiner* — Brian O Peters

(57) ABSTRACT

A vacuum pump includes a housing, a rotatable shaft extending in an axial direction within the housing, a first pumping arrangement including a first stator arrangement and a first rotor arrangement, and a second pumping arrangement including a second stator arrangement and a second rotor arrangement. The vacuum pump further includes a spacer arranged between the first pumping arrangement and the second pumping arrangement. The spacer is coupled between the first stator arrangement and the second stator arrangement and is configured to provide a defined elasticity in the axial direction allowing an elastic deformation of the spacer in the axial direction.

11 Claims, 3 Drawing Sheets

VACUUM PUMP WITH ELASTIC SPACER

RELATED APPLICATIONS

This application claims priority to UK Application No. GB 2019017.9, filed Dec. 2, 2020, the entire contents of which are incorporated herein by reference.

TECHNICAL FIELD

The present invention relates to vacuum pumps, in particular split-flow vacuum pumps having two gas inlets to a common rotor arrangement.

BACKGROUND

Known compound vacuum pumps often comprise a turbo-molecular pumping mechanism connected in series with a molecular drag pumping mechanism, the latter of which is typically a Gaede, Holweck, or Siegbahn pumping mechanism. The mechanisms are often driven by the same motor.

Molecular pumping mechanisms operate on the general principle that, at low pressures, gas molecules striking a fast-moving surface can be given a velocity component from the moving surface. As a result, the molecules tend to take up the same direction of motion as the surface against which they strike, which urges the molecules through the pump and produces a relatively higher pressure in the vicinity of the pump exhaust.

A conventional turbo-molecular stage arrangement of a vacuum pump typically comprises a stack of alternating rotors and stators. Each stage effectively comprises a solid disc with a plurality of blades depending (nominally) radially therefrom. The blades are evenly spaced around the circumference of the disc and angled "about" radial lines out of the plane of the disc in the direction of rotation of the rotor stage. The rotor and stator blades may have positive and negative gradients respectively when viewed from the side in a radial line from the disc. This arrangement has the effect in molecular flow conditions of causing the movement of molecules through the pump.

Molecular drag pumping mechanisms generally comprise a rotor and a stator provided with one or more helical or spiral channels opposing the rotor. Types of molecular drag pumping mechanisms include a Holweck pumping mechanism comprising two co-axial cylinders of different diameters defining a helical gas path therebetween by means of a helical thread located on either the inner surface of the outer cylinder or on the outer surface of the inner cylinder, and a Siegbahn pumping mechanism comprising a rotating disk opposing a disk-like stator defining spiral channels that extend from the outer periphery of the stator towards the center of the stator. Another example of a molecular drag pumping mechanism is a Gaede mechanism, whereby gas is pumped around concentric channels arranged in either a radial or axial plane. In this case, gas is transferred from stage to stage by means of crossing points between the channels and tight clearance 'stripper' segments between the adjacent inlet and outlet of each stage. Siegbahn and Holweck pumping mechanisms do not require crossing points or tight clearance 'stripper' segments because their inlets and outlets are disposed along the channel length.

There are a number of applications where a plurality of chambers needs to be evacuated down to different levels of vacuum. For example, in well-known types of mass spectrometer that part of the apparatus known as the detector commonly has to be operated at, say 10-6 mbar whereas that part known as the analyzer has to be operated at a different level of vacuum, say 10-3. In addition and importantly, the throughput of gas from the different parts of the apparatus will generally vary also. For example, in a typical mass spectrometer of the type discussed above, there may need to be a 60 liter/second (L/s) capacity for the detector and a 200 L/s capacity for the analyzer.

So-called split-flow vacuum pumps are known e.g. from EP919726A1 and provided having two gas inlets to a common rotor arrangement, thus in essence combining two vacuum pumps in serial connection with a common rotor within one housing. Such split-flow vacuum pumps allow evacuating at different vacuum levels and at different pumping capacity, so that a single split-flow vacuum pump can be used for evacuating a respective mass spectrometer.

Manufacturing of vacuum pumps (and in particular of split-flow vacuum pumps due to their higher complexity) requires a complex arrangement and alignment of components.

SUMMARY

It is an object to provide an improved manufacturing of vacuum pumps, in particular for split-flow applications.

According to an exemplary embodiment of the present invention, a vacuum pump is provided comprising a housing and a rotatable shaft extending in an axial direction within the housing. The vacuum pump further comprises a first pumping arrangement comprising a first stator arrangement and a first rotor arrangement, wherein the first stator arrangement is coupled with the housing, and the first rotor arrangement is coupled with and rotatable by the shaft in order to pump fluid when the first rotor arrangement is rotated with respect to the first stator arrangement. The vacuum pump further comprises a second pumping arrangement comprising a second stator arrangement and a second rotor arrangement, wherein the second stator arrangement is coupled with the housing, and the second rotor arrangement is coupled with and rotatable by the shaft in order to pump fluid when the second rotor arrangement is rotated with respect to the second stator arrangement. The vacuum pump further comprises a first pump inlet through which gas can pass through the first pumping arrangement and the second pumping arrangement, and a spacer arranged between the first pumping arrangement and the second pumping arrangement. The spacer is coupled between the first stator arrangement and the second stator arrangement and is configured to provide a defined elasticity in the axial direction allowing an elastic deformation of the spacer in the axial direction.

In one embodiment, the spacer is provided as an axial spring element.

In one embodiment, the spacer is configured to provide essentially the entire elasticity in the axial direction of all components in the vacuum pump coupled to the housing.

In one embodiment, the spacer is configured to provide essentially the entire elasticity in the axial direction between an upper part of the housing against which the first stator arrangement is abutting and a lower part of the housing against which the second stator arrangement is abutting.

In one embodiment, the spacer comprises an upper ring, a lower ring, and an elastic structure. The upper ring is configured to abut against the first stator arrangement, the lower ring is configured to abut against the second stator arrangement, and the elastic structure is arranged in the axial direction between the upper ring and the lower ring and configured to provide the defined elasticity in the axial direction.

In one embodiment, the elastic structure has a plurality of Z-shaped elements allowing an elastic deformation of the spacer in the axial direction, each Z-shaped element having a first leg coupled with one end to the upper ring, a second leg coupled with one end to the lower ring, and a third leg coupled between the other ends of the first leg and the second leg.

In one embodiment, the upper ring has a smaller diameter than the lower ring.

In one embodiment, the elastic structure has a plurality of step shaped elements allowing an elastic deformation of the spacer in the axial direction.

In one embodiment, the first stator arrangement and the second stator arrangement are coupled, preferably mechanically fixed, with the housing.

In one embodiment, the housing comprises an envelope and a body, wherein the first stator arrangement and the second stator arrangement are coupled, preferably mechanically fixed, with the envelope, and the body comprises a driving unit for rotating the shaft, wherein the spacer is configured for positioning the first stator arrangement and the second stator arrangement while maintaining the envelope and the body in contact with each other.

In one embodiment, the first pumping arrangement and the second pumping arrangement are arranged in series in the axial direction.

In one embodiment, at least one of the first pumping arrangement and the second pumping arrangement is one of: a turbomolecular pumping unit comprising one or more turbomolecular stages with each turbomolecular stage having a rotor and a stator, a molecular drag stage such as a Gaede pumping mechanism, a Holweck pumping mechanism, or a Siegbahn pumping mechanism.

In one embodiment, the vacuum pump is provided as a split-flow pump comprising a second pump inlet through which gas can pass only through the second pumping arrangement. The spacer is arranged between the first pumping arrangement and the second pumping arrangement in proximity to the second pump inlet.

Embodiments of the present invention provide a new design of a spacer as a stator part to ensure fixing and fight positioning of turbopump's stators while maintaining the envelope and the body of the pump in contact (thus improving the internal heat dissipations). The spacer also allows to direct an axial position of the elastic force (e.g., to axially locate the elastic force necessary to keep the stators in position) e.g., to a middle section of the stators' stack (between first and second pumping arrangements), allowing to reduce a variability of axial clearances between rotor and stator. The spacer further allows to avoid usage of other elastic elements, such as metallic springs, which are typically placed between the highest stator and the envelope.

In one embodiment, the spacer has upper and lower interface annuluses of different diameters, with an elastic section in between provided as a spring, e.g. being Z-shaped. Using this design concept, it will be possible to vary the values of the axial "stators' stack compressing" force. Parameters on which to act to design a required elasticity can be e.g., a shaping and/or a thickness of and/or angular openings in the elastic section. With the correct calculations and necessary precautions (e.g., calibrated plasticization of the component before mounting), it can be possible to reduce variability in component's force.

Also, this newer design can take advantage of the lower plasticization values of the aluminum (with respect to the steel—typical choice for spring material—values), giving the chance of better "controlling" the force value achieved, reducing its variability: to do this, it will be possible to compress the spacer to a previously calculated value before assembly, in order to plasticize it thus evening its reaction force when it will be mounted. In that case, since we provide to deform and plasticize the component, tolerances on its "free" height could be accepted looser than by using it as a "simple" spacer.

The operating principle can be quite intuitive: in defining the chain of axial heights and tolerances of all stators' stack components, the spacer is provided to be always "compressed" between the parts above and below it.

BRIEF DESCRIPTION OF DRAWINGS

Other objects and many of the attendant advantages of embodiments of the present invention will be readily appreciated and become better understood by reference to the following more detailed description of embodiments in connection with the accompanying drawing(s). Features that are substantially or functionally equal or similar will be referred to by the same reference sign(s). The illustration in the drawing is schematically.

DETAILED DESCRIPTION

Figure 1:
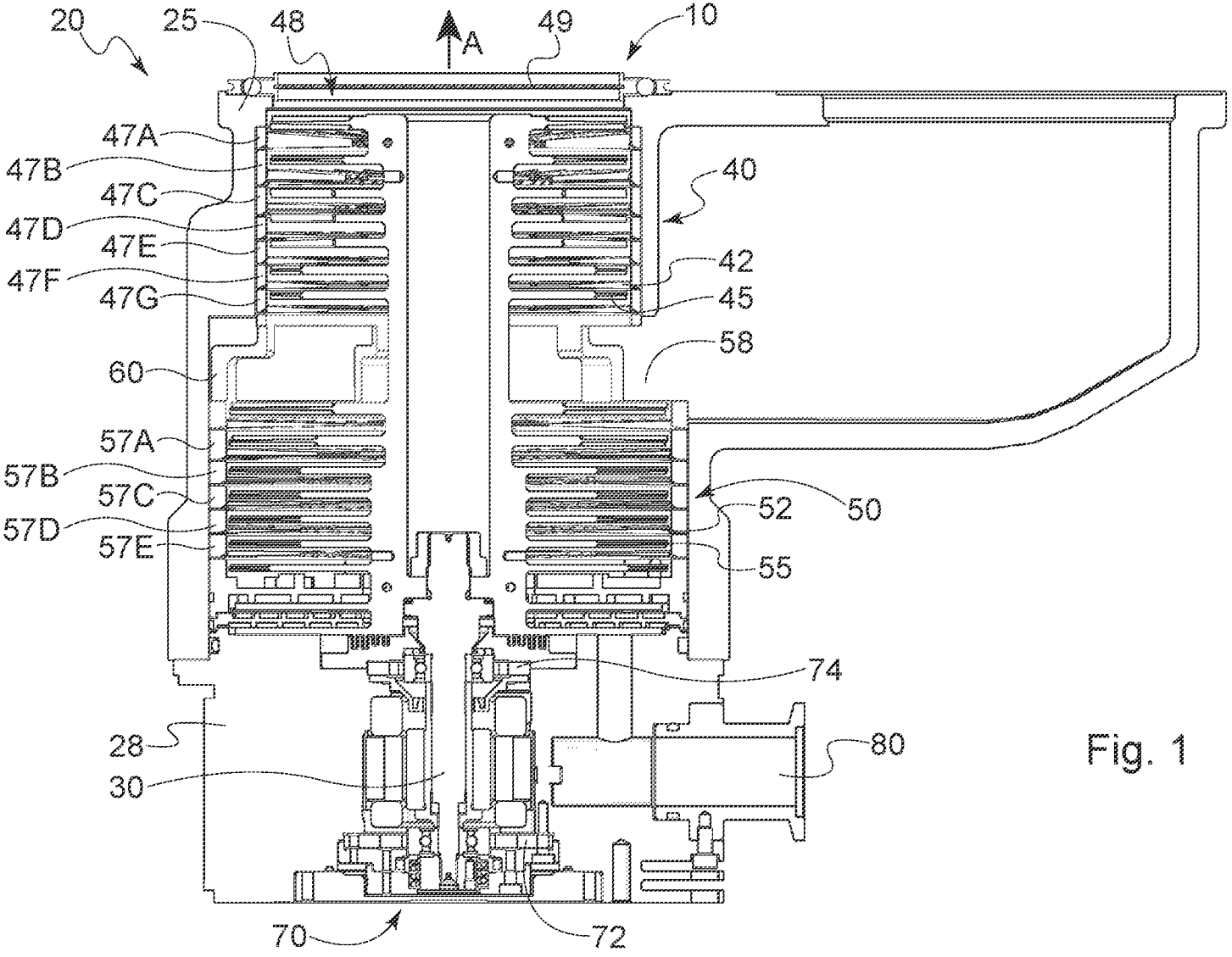
FIG. 1 shows a split-flow vacuum pump according to an embodiment of the present disclosure.

FIG. 1 shows a split-flow vacuum pump 10 according to an embodiment of the present invention. The vacuum pump 10 has a housing 20 which comprises an envelope 25 and a body 28. A shaft 30 is arranged and extending in an axial direction (indicated by arrow A) within the housing 20.

The envelope 25 houses a first pumping arrangement 40 comprised of a first stator arrangement 42 and a first rotor arrangement 45. The first rotor arrangement 45 is mechanically attached with the shaft 30, while the first stator arrangement 42 is mechanically attached with the envelope 25 of the housing 20. The first pumping arrangement 40 in the embodiment of FIG. 1 is provided by seven turbomolecular stages 47A-47G, each stage consisting of a respective turbomolecular rotor element (being part of the first rotor arrangement 45) and a respective turbomolecular stator element (being part of the first stator arrangement 42), as readily known in the art, which in operation rotate with respect to each other to cause movement of molecules (under molecular flow conditions) through the pump 10.

A first pump inlet 48 is provided on top side (with respect to the representation shown in FIG. 1) of the pump 10 and in closest proximity to the first turbomolecular stage 47A of the first pumping arrangement 40. A flange 49 can be provided to close the first pump inlet 48 e.g. for transporting.

The envelope 25 further houses a second pumping arrangement 50 comprised of a second stator arrangement 52 and a second rotor arrangement 55. The second rotor arrangement 55 is mechanically attached with the shaft 30, while the second stator arrangement 52 is mechanically attached with the envelope 25 of the housing 20. The second pumping arrangement 50 in the embodiment of FIG. 1 is provided by five turbomolecular stages 57A-57E, each stage consisting of a respective turbomolecular rotor element (being part of the second rotor arrangement 55) and a respective turbomolecular stator element (being part of the second stator arrangement 52), as readily known in the art, which in operation rotate with respect to each other to cause movement of molecules (under molecular flow conditions) through the pump 10.

A second pump inlet 58 is provided at a lateral side (with respect to the representation shown in FIG. 1) of the pump 10 and in closest proximity to the first turbomolecular stage 57A of the second pumping arrangement 50.

A spacer 60 is provided between the first pumping arrangement 40 and the second pumping arrangement 50 and arranged in proximity to the second pump inlet 58. Exemplary embodiments of the spacer 60 will be shown in greater detail in FIGS. 2A-3C.

The body 28 can be mechanically attached to the envelope 25 e.g. by one or more screws, thus fixing the body 28 and the envelope 25 closely together in the axial direction A.

The body 28 in the embodiment of FIG. 1 comprises a driving unit 70 coupled to and allowing to rotate the shaft 30. A first bearing 72 and a second bearing 74 are provided for bearing rotation of the shaft 30. It is clear that the bearings 72 and 74 may also be provided at other positions (with respect to the shaft 30). For example, the (upper) second bearing 74 may be provided higher up (in the representation of FIG. 1) towards the first pump inlet 48.

The pump 10 further comprises an outlet 80.

For operation, the first pump inlet 48 of the pump 10 can be coupled to a first chamber to be evacuated (not shown in FIG. 1) and the second pump inlet 58 can be coupled to a second chamber to be evacuated (not shown in FIG. 1). When rotating the shaft 30, gas from the first chamber (to be evacuated) will be sucked in by the pump 10 at the first pump inlet 48, pass through the first pumping arrangement 40 as well as the second pump arrangement 50, and exit through the outlet 80. Gas from the second chamber (to be evacuated) will be sucked in by the pump 10 at the second pump inlet 58, pass (only) through second pump arrangement 50, and also exit through the outlet 80.

Figure 2A:
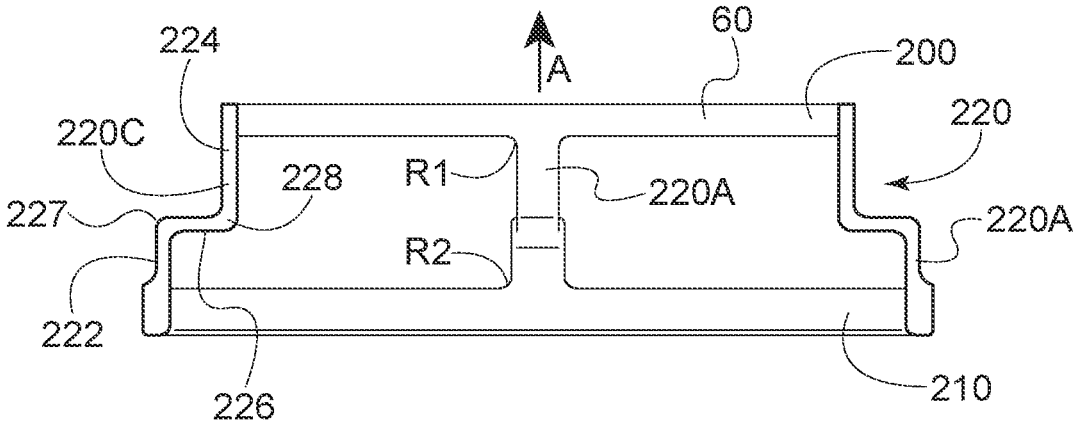
FIG. 2A is a cross-sectional elevation view of a spacer according to an embodiment of the present disclosure.
Figure 2B:
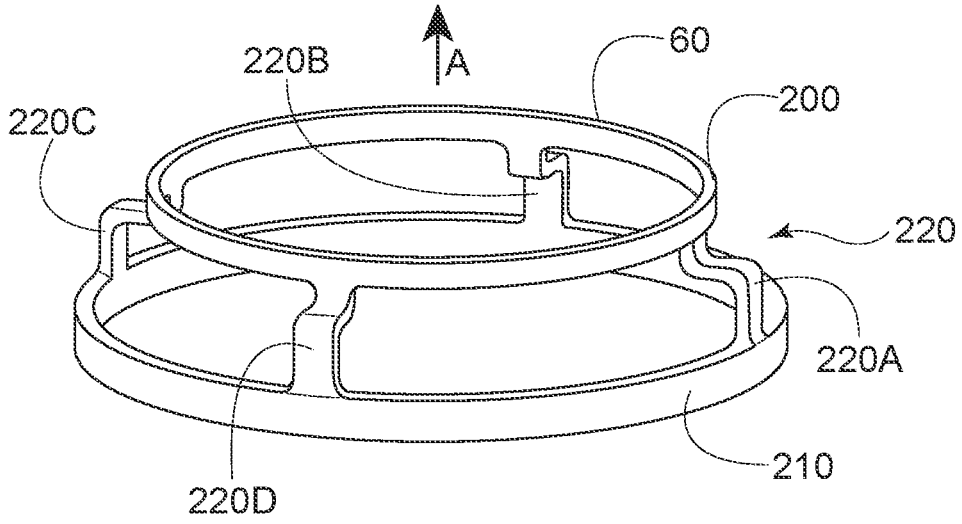
FIG. 2B is a perspective view of the spacer illustrated in FIG. 2A.

FIGS. 2A and 2B illustrate one exemplary embodiment of the spacer 60, with FIG. 2A showing a (cut-through) cross-sectional view, and FIG. 2B showing a three-dimensional view. The spacer 60 comprises an upper ring 200, a lower ring 210, and an elastic structure 220. The upper ring 200 is configured to abut against the first stator arrangement 42, and in the embodiment of FIG. 1 against the lowest turbomolecular stage 47G (with respect to the first pump inlet 48). The lower ring 210 is configured to abut against the second stator arrangement 52, and in the embodiment of FIG. 1 against the upper turbomolecular stage 57A (with respect to the first pump inlet 48).

The elastic structure 220 is arranged in the axial direction A between the upper ring 200 and the lower ring 210 and configured to provide a defined elasticity in the axial direction A. Accordingly, when the envelope 25 and the body 28 are mechanically tightened to each other (e.g. by screwing one or more screws), the stator of the pump 10 (consisting of the first stator arrangement 42, the second stator arrangement 52, and the spacer 60 coupled in between the first stator arrangement 42 and the second stator arrangement 52) is mechanically fixed and prestressed in the axial direction A within the housing 20. While the first stator arrangement 42 and the second stator arrangement 52 are provided as mechanically rigid components substantially providing no elasticity in the axial direction A, the spacer 60 is configured "spring-like" i.e., having a defined elasticity in the axial direction A. In other words, a force acting in the axial direction A will lead to an elastic deformation of the spacer 60 in the axial direction A. On removal of the force in the axial direction A, the spacer 60 will substantially resume its initial shape (before applying the force in axial direction A).

The spacer 60 thus provides an elastic spring element that allows to hold firmly in position (in particular axially) the entire package of stators of the first pumping arrangement 40 and the second pumping arrangement 50, while allowing the closure of the contact between the body 28 and the envelope 25. Without a defined elasticity of the spacer 60 (which may be considered as an elastic "yielding" element), there is a risk that the envelope 25 and the second pumping arrangement 50 do not come into contact, which may reduce a heat exchange between the parts. Moreover, without the defined elasticity of the spacer 60, the axial positioning of the stator components of the first pumping arrangement 40 and the second pumping arrangement 50 would be more variable, which may force the designer to maintain greater axial gaps between rotor and stators, thus decaying the performance of the turbomolecular pump.

In the embodiment of FIGS. 2A and 2B, the elastic structure 220 is comprised of a plurality of step shaped rips (or ribs) 220, presently embodied having a Z-shape. The embodiment of FIG. 2 is shown with four rips 220A-220D, however, the number of rips can be considered as a design parameter allowing to adjust the desired degree of axial elasticity of the spacer 60. In the exemplary embodiment of FIG. 2, each rip 220 comprises a first axial bar 222 extending in the axial direction A from the lower ring 210, a second axial bar 224 extending in the axial direction A from the upper ring 200, and a horizontal (or radial) bar 226 bridging between the first axial bar 222 and the second axial bar 224. In other words, a first end of the first axial bar 222 is fixed to the lower ring 210, while a second end of the first axial bar 222 is fixed via a first bending 227 to a first end of the horizontal bar 226, and a first end of the second axial bar 224 is fixed to the upper ring 220, while a second end of the second axial bar 224 is fixed via a second bending 228 to a second end of the horizontal bar 226.

The Z-shape of the elastic structure 220 allows the upper ring 200 and lower ring 210 to be elastically pressed against each other in the axial direction A, i.e. the elastic structure 220 can undergo an elastic deformation into the axial direction A.

The elasticity of the elastic structure 220 can be designed to assume a defined and/or desired value of elasticity in particular by designing one or more of the parameters: material, breadth, height, and/or thickness of the first axial bar 222, the second axial bar 224, the horizontal part 226, the first bending 227, and/or the second bending 228, radius of the first bending 227 and/or the second bending 228, number of rips 220, a radius R1 of a rounding between the first axial bar 222 and the lower ring 210, a radius R2 of a rounding between the second axial bar 224 and the upper ring 200, et cetera.

Figure 3A:
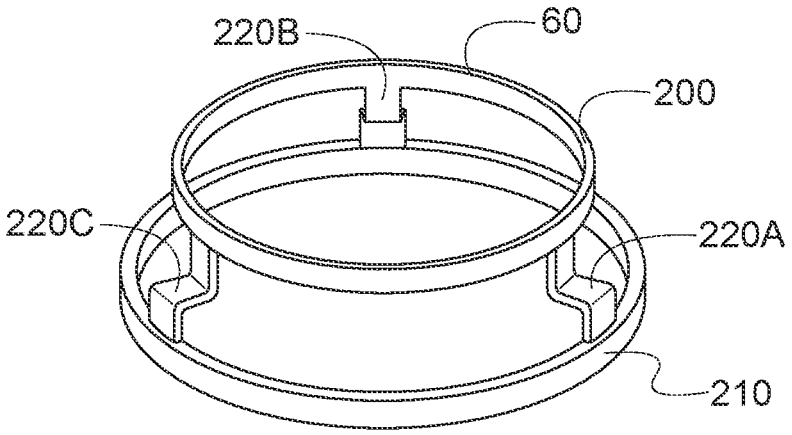
FIG. 3A is a perspective view of a spacer according to another embodiment of the present disclosure.
Figure 3B:
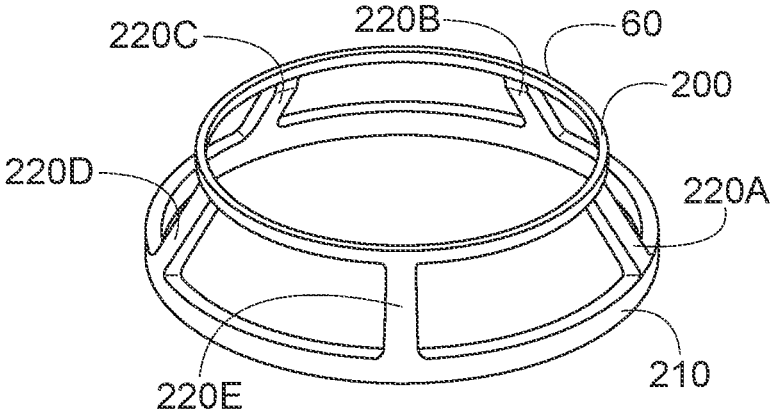
FIG. 3B is a perspective view of a spacer according to another embodiment of the present disclosure.
Figure 3C:
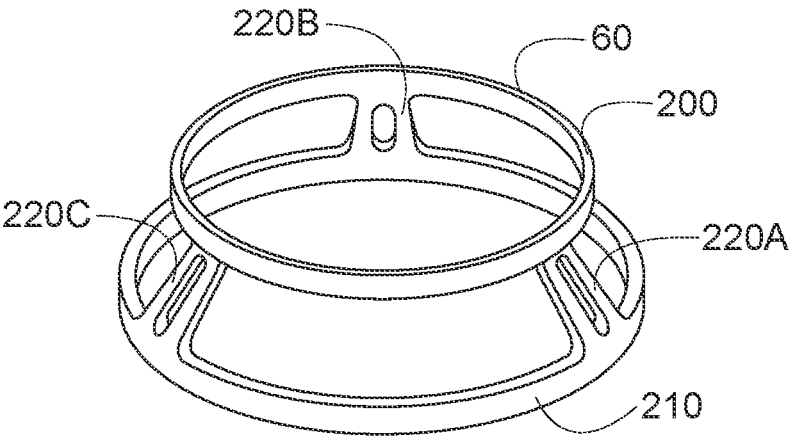
FIG. 3C is a perspective view of a spacer according to another embodiment of the present disclosure.

FIGS. 3A-3C show additional exemplary embodiments of the spacer 60. FIG. 3A shows an embodiment similar to FIGS. 2A and 2B, however with only three Z-shaped rips (or ribs) 220A-C. FIG. 3B shows an embodiment with five rips (or ribs) 220A-220E each extending straight between the upper ring 200 and the lower ring 210. FIG. 3C shows an embodiment similar to FIG. 3B, however, with only three rips (or ribs) 220A-C each embodied as double-rip (or double-rib) having a cut-out in between.

While the invention has been exemplarily described with respect to an embodiment as a split-flow pump, it is clear that a respective spacer 60 according to embodiment of the present invention can also be applied in other types of vacuum pumps with only one pump inlet as well as with more than two pump inlets. In the latter, a respective spacer may be applied in close proximity to one or more of the pump inlets.

While the invention has been exemplarily described with respect to an embodiment having two pumping arrangements (40 and 50), it is clear that more than two pumping arrangements can be applied, e.g. with a respective spacer 60 according to embodiments of the present invention situated axially between adjacent pumping arrangements.

The invention claimed is:

1. A vacuum pump, comprising:

a housing;

a rotatable shaft extending in an axial direction within the housing;

a first pumping arrangement comprising a first stator arrangement and a first rotor arrangement, wherein the first stator arrangement is coupled with the housing, and the first rotor arrangement is coupled with and rotatable by the shaft to pump fluid when the first rotor arrangement is rotated with respect to the first stator arrangement;

a second pumping arrangement comprising a second stator arrangement and a second rotor arrangement, wherein the second stator arrangement is coupled with the housing, and the second rotor arrangement is coupled with and rotatable by the shaft to pump fluid when the second rotor arrangement is rotated with respect to the second stator arrangement;

a pump inlet through which gas can pass through the first pumping arrangement and the second pumping arrangement; and a spacer arranged between and abutting the first pumping arrangement and the second pumping arrangement, wherein:

the spacer comprises a plurality of ribs and a plurality of openings, each opening separating two of the ribs, and the ribs are step-shaped; and the spacer is configured to provide a defined elasticity in the axial direction allowing an elastic deformation of the spacer in the axial direction, and the spacer is more elastic than the first stator arrangement and the second stator arrangement such that, in response to a force acting in the axial direction, the elastic deformation of the spacer in the axial direction is greater than an elastic deformation of the first stator arrangement and the second stator arrangement in the axial direction.

2. The vacuum pump of claim 1, wherein the spacer is provided as an axial spring element.

3. The vacuum pump of claim 1, wherein the spacer is configured to provide essentially the entire elasticity in the axial direction of all components in the vacuum pump coupled to the housing.

4. The vacuum pump of claim 1, wherein the spacer comprises an upper ring, a lower ring, and an elastic structure, and wherein:

the upper ring is configured to abut against the first stator arrangement;

the lower ring is configured to abut against the second stator arrangement; and the elastic structure is arranged in the axial direction between the upper ring and the lower ring and configured to provide the defined elasticity in the axial direction.

5. The vacuum pump of claim 4, wherein each rib comprises a first leg coupled with one end to the upper ring, a second leg coupled with one end to the lower ring, and a third leg coupled between the other ends of the first leg and the second leg.

6. The vacuum pump of claim 4, wherein the upper ring has a smaller diameter than the lower ring.

7. The vacuum pump of claim 1, comprising at least one of:

the first stator arrangement and the second stator arrangement are coupled with the housing;

the housing comprises an envelope and a body, wherein the first stator arrangement and the second stator arrangement are coupled with the envelope, and the body comprises a driving unit for rotating the shaft, and wherein the spacer is configured for positioning the first stator arrangement and the second stator arrangement while maintaining the envelope and the body in contact with each other.

8. The vacuum pump of claim 1, wherein the first pumping arrangement and the second pumping arrangement are arranged in series in the axial direction.

9. The vacuum pump of claim 1, wherein at least one of the first pumping arrangement and the second pumping arrangement is selected from the group consisting of: a turbomolecular pumping unit comprising one or more turbomolecular stages with each turbomolecular stage having a rotor and a stator; a molecular drag stage; a Gaede pumping mechanism; a Holweck pumping mechanism; and a Siegbahn pumping mechanism.

10. The vacuum pump of claim 1, wherein the pump inlet through which gas can pass through the first pumping arrangement and the second pumping arrangement is a first pump inlet, and further comprising a second pump inlet through which gas can pass only through the second pumping arrangement, wherein the spacer is arranged between the first pumping arrangement and the second pumping arrangement in proximity to the second pump inlet.

11. The vacuum pump of 1, wherein the spacer has a circumference orthogonal to the axial direction, the ribs have an arc length along the circumference, and the openings have an arc length along the circumference greater than the an arc length of the ribs.

* * * * *